US009090101B2

(12) United States Patent
Shima

(10) Patent No.: US 9,090,101 B2
(45) Date of Patent: Jul. 28, 2015

(54) PRINTING METHOD AND APPARATUS

(71) Applicant: CANON KABUSHIKI KAISHA, Tokyo (JP)

(72) Inventor: Takeaki Shima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/302,938

(22) Filed: Jun. 12, 2014

(65) Prior Publication Data

US 2014/0368590 A1 Dec. 18, 2014

(30) Foreign Application Priority Data

Jun. 14, 2013 (JP) ..... 2013-125711

(51) Int. Cl.
*B41J 2/01* (2006.01)
*B41J 11/00* (2006.01)

(52) U.S. Cl.
CPC ..... *B41J 11/0015* (2013.01); *B41J 11/002* (2013.01)

(58) Field of Classification Search
USPC ..... 347/102, 101, 16
See application file for complete search history.

(56) References Cited

U.S. PATENT DOCUMENTS

| | | | | |
|---|---|---|---|---|
| 5,579,693 | A * | 12/1996 | Carreira et al. | 101/424.1 |
| 8,845,074 | B2 * | 9/2014 | Hawryschuk et al. | 347/34 |
| 2006/0001721 | A1 * | 1/2006 | Yraceburu et al. | 347/102 |
| 2012/0133698 | A1 * | 5/2012 | Kato | 347/16 |

FOREIGN PATENT DOCUMENTS

JP 2001-212950 A 8/2001

* cited by examiner

*Primary Examiner* — Henok Legesse
(74) *Attorney, Agent, or Firm* — Canon USA, Inc. I.P. Division

(57) ABSTRACT

An image is printed by ink on a first face of a sheet of which the first face has low absorbency and the second face has a water-absorbing property greater than the first face. The first face of the sheet that has been printed upon is heated and the second face is moisturized.

11 Claims, 10 Drawing Sheets

PRINTING METHOD AND APPARATUS

BACKGROUND

1. Field

Aspects of the present invention generally relate to a printing method and apparatus which performs heating to fix ink.

2. Description of the Related Art

There is attention being focused on a field where large format resin sheets are used to make highly weatherproof prints used for outdoor display and the like. Japanese Patent Laid-Open No. 2001-212950 discloses a printer which performs ink-jet printing on a sheet having a resin layer, and performs heating to fix ink.

A vinyl chloride sheet, which is representative of large format resin sheets, is formed of a thermoplastic resin film. Generally, an adhesive agent with weak adhesion strength is coated on the rear face side from the printed face to which ink has been applied, and peeling paper is applied thereupon, to facilitate display thereof. The present inventor has found the following problems to occur when using such a resin sheet having peeling paper.

The thermoplastic resin film of the vinyl chloride sheet softens under application of heat. On the other hand, when heated, the moisture in the peeling paper on the rear face side evaporates, and the peeling paper shrinks. That is to say, shrinkage of the peeling paper causes the entire sheet to shrink.

Analyzing in further detail reveals that at the time of heating to fix the ink applied to the sheet, the evaporation of the moisture included in the ink robs heat therefrom in the form of vaporization heat, which affects shrinkage of the sheet. The sheet shrinkage changes depending on the amount of ink applied to the sheet for printing, and the regions to which the ink has been applied. That is to say, the amount of heat robbed due to vaporization heat differs for each printed article printed with a different image, so sheet shrinkage is not uniform.

Different shrinkage among printed articles is problematic when creating a display of multiple printed articles arrayed with no space therebetween. An image may not smoothly connect to the adjacent image, and portions where the images connect may be visually recognized to viewers as seam streaks. The human eye is sensitive to even slight streaks.

SUMMARY

Aspects of the present invention are generally related to suppressing shrinking of a sheet during heating to fix ink applied thereto during printing using a sheet having a first face with low absorbency and a second face of which water-absorbing property is greater than that of the first face.

An aspect of the present invention is generally directed to a printing method including preparing a sheet having a first face and a second face, wherein the first face has low absorbency and the second face has a water-absorbing property greater than the first face, printing an image with ink on the first face, and heating the printed first face and moisturizing the second face.

Further features of the present disclosure will become apparent from the following description of exemplary embodiments with reference to the attached drawings.

DESCRIPTION OF THE EMBODIMENTS

An ink-jet printing apparatus which prints on large format sheets will be exemplified as an exemplary embodiment. Note that the present disclosure is widely applicable to printing apparatuses which print on sheets by a method other than the ink-jet method, and then use a heating device to fix the image to the sheet.

First, description will be made regarding sheets which are anticipated in the present embodiment. While various types of large format sheets are available, we will use a vinyl chloride sheet which is representative of resin sheets. Note that the sheet is not restricted to vinyl chloride, and that other resin films with low absorbency, such as acrylic, polyolefine, polypropylene, and so forth, may be used. The vinyl chloride sheet is used as a roll sheet rolled on a paper tube, and may be several meters wide. The printing face of the sheet is a vinyl chloride film, and an adhesive agent with weak adhesion strength is coated on the entirety of the rear face side. In the present specification, the sheet face where printing is performed will be referred to as the first face, and the rear face therefrom as the second face. Peeling paper is applied to the face where the adhesive agent has been applied. The peeling paper is paper smaller than 60 in St•ckigt sizing degree. The moisture included in such peeling paper evaporates under heat, and the paper shrinks.

A silicone sheet may have been applied to the front face or both faces of the peeling paper to reduce shrinkage. Further, it is sufficient that the sheet have a configuration of multiple layers, including a printing face with low absorbency and a rear face of which water-absorbing property is greater than that of the printing face. The term "low absorbency" means St•ckigt sizing degree of 60 or greater. Also note that hereinafter, the term "vinyl chloride sheet" as used in the present specification means one where peeling paper is applied to the rear face.

Figure 1:
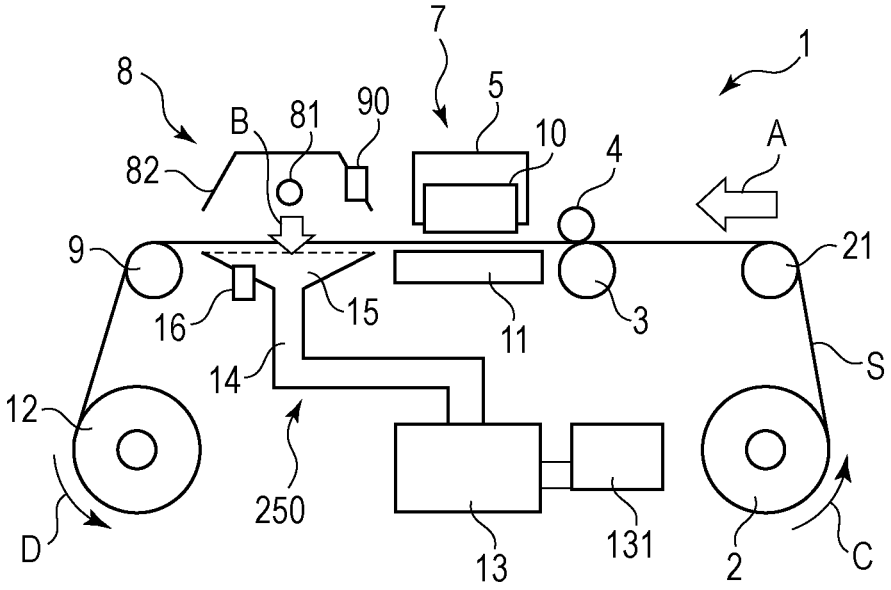
FIG. 1 is a cross-sectional diagram illustrating the configuration of a printing apparatus according to a first embodiment.

FIG. 1 is a cross-sectional view of the entire configuration of an ink-jet printing apparatus according to the present embodiment. The printing apparatus 1 includes the following four primary units, which are a conveyance unit to convey sheets S, a printing unit 7 to print images on sheets S by the ink-jet method, a heating unit 8 to heat the printing face of sheets S on which ink has been applied, and a moisturizing unit 250 to moisturize the rear face of the sheets S. The present embodiment is particularly noteworthy in the provision of the moisturizing unit 250, the reason of which will be described later.

The configuration of the conveyance unit will now be described. The conveyance unit includes a sheet supply unit 2, a turn roller 21, a conveyance roller pair made up of a conveyance roller 3 and a pinch roller 4, a turn roller 9, and a wind-up unit 12. A rolled sheet S is rotatably attached to the sheet supply unit 2. The sheet S set to the sheet supply unit 2 is rotated in the direction of the arrow C, so as to unroll the leading end of the sheet. The unrolled sheet leading end passes over the turn roller 21, through the conveyance roller pair, over the turn roller 9, and reaches the wind-up unit 12. The wind-up unit 12 is driven by a wind-up motor to rotate in the direction of the arrow D while printing, so as to wind up the sheet S after printing. The conveyance direction of the sheet S during printing is the direction of the arrow A. We will define this direction as a sub-scanning direction. The conveyance roller 3 is rotationally driven by the conveyance motor, so as to intermittently convey sheets S. The conveyance roller 3 has a length corresponding to the maximum sheet width, and may be divided into a plurality or formed integrally. A rotary encoder to detect the rotation amount of the conveyance roller 3 is attached to the end of the rotation shaft of the conveyance roller 3. The pinch roller 4 is a driven roller which rotates according to the rotational driving of the conveyance roller 3.

The configuration of the printing unit 7 will be described. The printing unit 7 includes a carriage 5, a print head 10, and a platen 11. The carriage 5 is moved reciprocally in the main scanning direction by the carriage motor, while holding the print head 10. The main scanning direction is a direction orthogonal to the sub-scanning direction, and is the perpendicular direction to the plane of the drawing in FIG. 1. Also provided is a linear encoder to detect the position of the carriage 5 which moves reciprocally.

The print head 10 may be any of a type using a heater, a type using a piezoelectric device, a type using an electrostatic element, or a type using an MEMS element. Ink ejected from the print head 10 is emulsion ink (dispersion ink). This emulsion ink works as follows. Ink droplets discharged onto the sheet are subjected to application of heat, whereby a film is formed, and the droplets are solidified and fixed to the surface of the sheet. While emulsion ink is used with the present embodiment, this is not restrictive. The platen 11 is at a position facing the print head 10, so as to guarantee the flatness of the printing face of the sheet S. The platen 11 may have functions such as air suction, electrostatic adsorption, or the like.

The configuration of the heating unit 8 will be described. The heating unit 8 is configured including a fixing heater 81 which is a heat source, a reflector 82, and a temperature sensor 90. The fixing heater 81 is a radiant heat discharging type in the present embodiment. The reflector 82 is a unit which deflects the direction of discharge of radiant heat of the fixing heater 81 toward the direction indicated by B in FIG. 1. The temperature sensor 90 is a non-contact thermometer which can directly measure the temperature of the sheet S. The detected temperature information is obtained from the temperature sensor 90, and the temperature of the sheet S is controlled to a predetermined temperature by way of a control unit. The temperature of the sheet S is controlled within a range of approximately 60° C. to 100° C. so that the emulsion ink will form a film and be fixed. The fixing heater 81 is not restricted to being a radiant heat discharging type, and may be a contact type heater which heats the sheet from the rear side, or some other heating arrangement.

The configuration of the moisturizing unit 250 will be described. The moisturizing unit 250 is configured including a water tank 131, a steam generating unit 13, a steam duct 14, an evacuation port 15, and a humidity sensor 16. Water is stored in the water tank 131, and is supplied to the steam generating unit 13. The steam generating unit 13 evaporates the water supplied from the water tank 131 using the electrothermal heater 220. Ultrasonic vibration or the like may be used for the steam generating unit 13 instead. The steam duct 14 communicates with the evacuation port 15, so that the generated steam is guided to the rear face side of the sheet S, thereby moisturizing the rear face of the sheet S. The humidity sensor 16 measures the humidity near the rear face of the sheet S. The detection information of the humidity sensor 16 is obtained, and the humidity near the rear face of the sheet S is controlled by way of the control unit so as to be a predetermined humidity.

Figure 2:
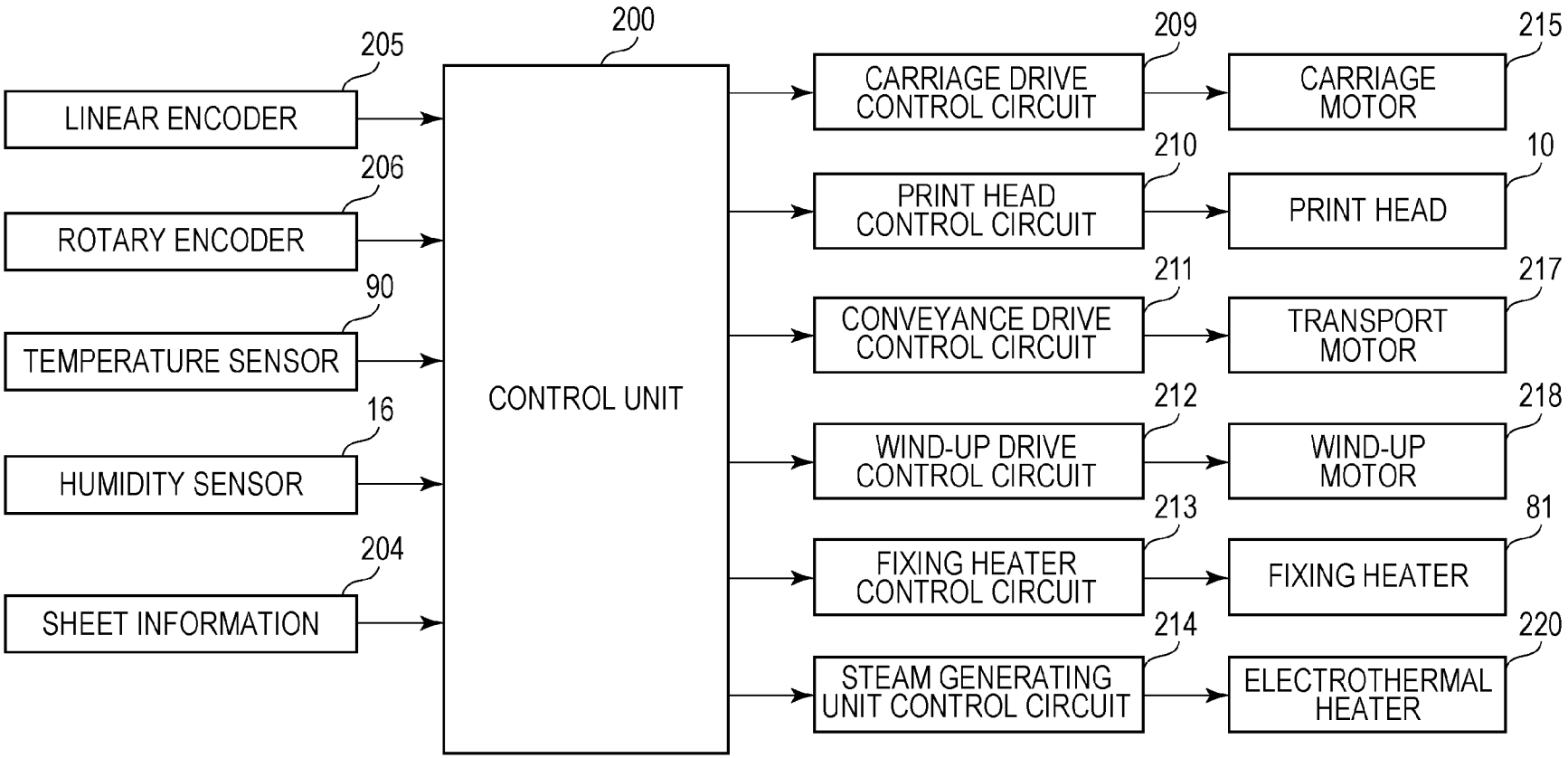
FIG. 2 is a system block diagram of the printing apparatus.

FIG. 2 is a system block diagram illustrating the printing apparatus according to the present embodiment. The control unit 200 is a control unit which controls the overall printing apparatus. The control unit 200 includes a microprocessor such as a central processing unit (CPU), read only memory (ROM) which stores control programs and the like for the CPU, random access memory (RAM) which saves various types of data, and so forth. A linear encoder 205 to detect the amount of motion of the carriage 5, a linear encoder 206 to detect the amount of rotation of the conveyance roller 3, the temperature sensor 90 of the heating unit 8, and the humidity sensor 16 of the moisturizing unit 250, are connected to the control unit 200. A carriage motor 215, the print head 10, a conveyance motor 217, a wind-up motor 218, the fixing heater 81, and the electrothermal heater 220, are connected to the control unit 200 via control circuits 209, 210, 211, 212, 213, and 214, respectively, and are each driven in accordance with instructions from the control unit 200. Sheet information 204 is input by the user from an input unit such as a host personal computer (PC) or an operation panel provided to the printing apparatus, and is transmitted to the control unit 200. The control unit 200 determines a humidity suitable for the type (properties) of the sheet to be used, and drives the electrothermal heater 220 by way of the steam generating unit control circuit 214. Adjusting the amount of steam being generated allows the amount of moisturizing of the rear face of the sheet S to be changed.

Figure 3:
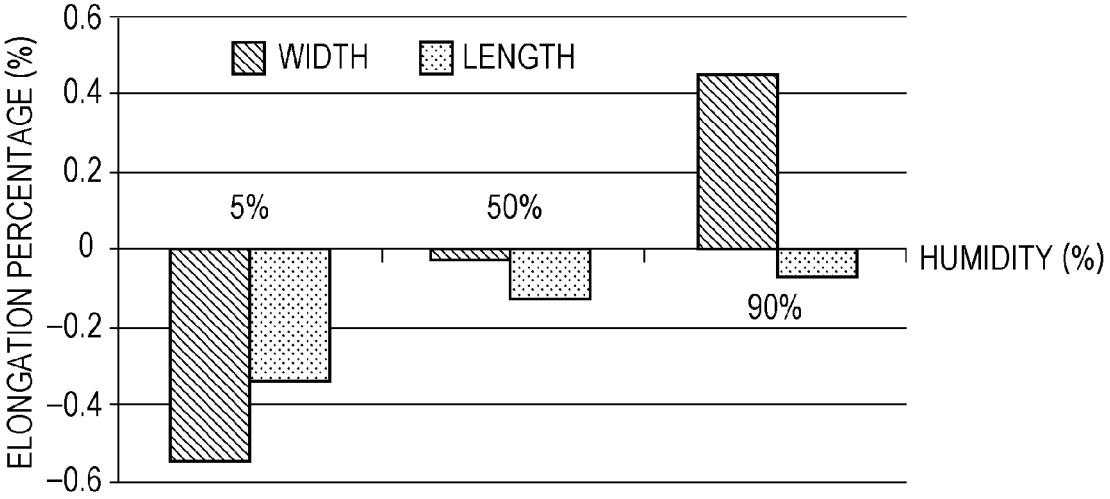
FIG. 3 is a graph illustrating shrinkage of a vinyl chloride sheet at different humidity conditions at 90° C.

FIG. 3 is a graph illustrating the elongation percentage of a vinyl chloride sheet at various humidities at 90° C. The vertical axis represents elongation percentage, and the horizontal axis represents the humidity at the rear face of the sheet S. The hatched bars represent the elongation percentage of the sheet S in the width direction (main scanning direction) of the sheet S, and the shaded bars represent the elongation percentage of the sheet S in the length direction (sub scanning direction). Market research has revealed that elongation percentage of ±0.1% for outdoor poster is negligible.

As illustrated in FIG. 3, the sheet S shrinks too much at humidity of 5%, so the elongation percentage is −0.5%. On the other hand, raising the humidity to 90% results in the sheet S expanding too much, so the elongation percentage is +0.5%. Setting the humidity to 50% enables the elongation percentage to be kept within ±0.1%, thereby meeting the demands of the specifications obtained by market research. Thus, the humidity around the rear face of the sheet S is preferably controlled to approximately 50%.

The moisturizing unit 250 and the heating unit 8 face each other across the sheet S at a position downstream from the printing unit 7 in the sub-scanning direction, thereby performing heating and moisturizing at the same time. Thus, shrinkage of the sheet S due to moisturizing before shrinkage due to heating can be suppressed.

Figure 4A:
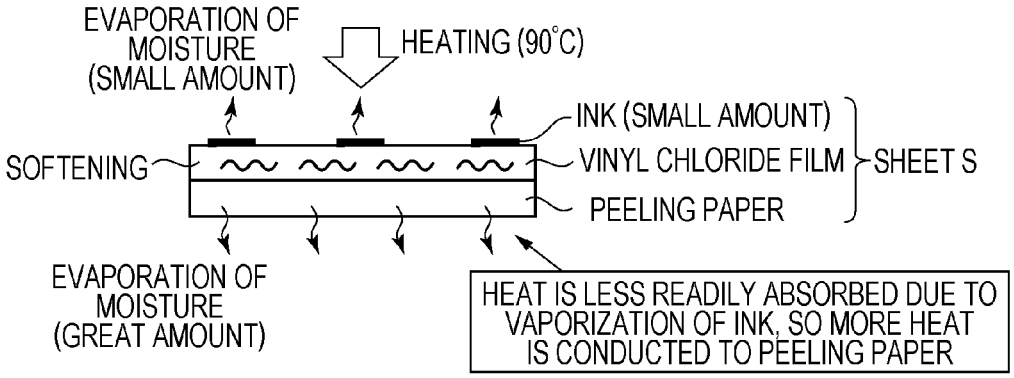
FIGS. 4A through 4C are drawings which illustrate shrinkage processes of a sheet (in a case where the amount of ink is little).
Figure 4B:
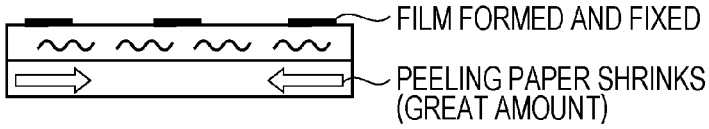
Figure 4C:
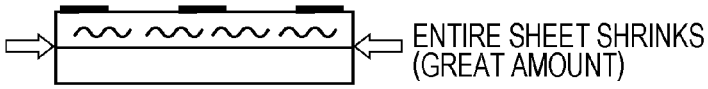
Figure 5A:
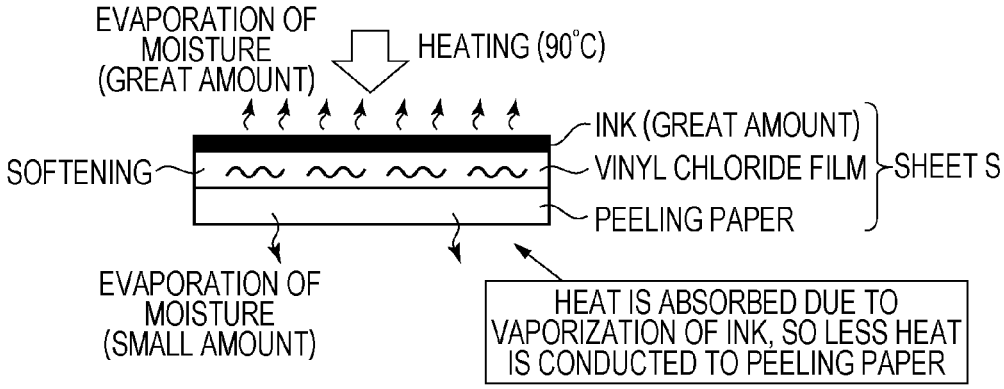
FIGS. 5A through 5C are drawings which illustrate shrinkage processes of a sheet (in a case where the amount of ink is great).
Figure 5B:
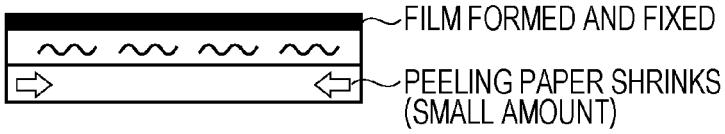
Figure 5C:
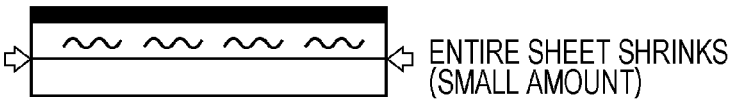

Now, the mechanism whereby the sheet S shrinks under application of heat will be described with reference to FIGS. 4A through 5C. FIGS. 4A through 4C illustrate a case where the amount of ink applied to the sheet S is little, and FIGS. 5A through 5C illustrate a case where the amount of ink applied to the sheet S is great. Heating the sheet S to the predetermined temperature (approximately 90° C.) causes the solvent (water) included in the ink to evaporate, the vinyl chloride film to soften due to heat, and the moisture in the peeling paper to evaporate (FIGS. 4A and 5A). Upon loosing moisture, the ink forms a film and is fixed, and the peeling paper dries and begins to shrink (FIGS. 4B and 5B). At this time, the softened vinyl chloride film which has softened shrinks due to being pulled by the shrinkage of the peeling paper, so the entire sheet S shrinks (FIGS. 4C and 5C).

There is variance in the shrinkage of the sheet S, in accordance with the amount of ink applied thereto. If the amount of ink discharged onto the sheet is small, the amount of heat stored in the sheet S that is used for vaporization heat of the ink is small. Accordingly, a great amount of heat is used for vaporization heat to evaporate the moisture in the peeling paper. Accordingly, the amount of moisture evaporating from the peeling paper is great, so the peeling paper readily shrinks (FIGS. 4A through 4C). On the other hand, if the amount of ink discharged onto the sheet is great, the amount of heat stored in the sheet S that is used for vaporization heat of the ink is great. Accordingly, little heat is used for vaporization heat to evaporate the moisture in the peeling paper, so the peeling paper does not readily shrink (FIGS. 5A through 5C).

Figure 6A:
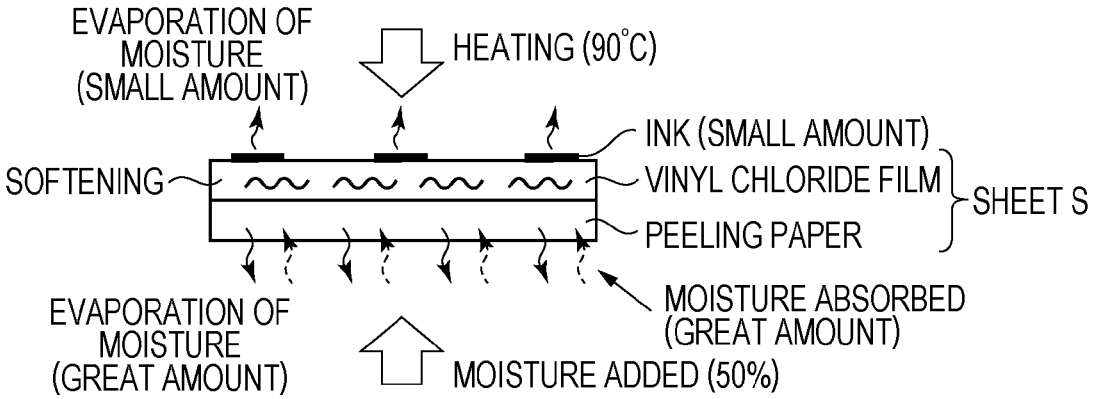
FIGS. 6A and 6B illustrate shrinkage processes of a sheet which has been moisturized.
Figure 6B:
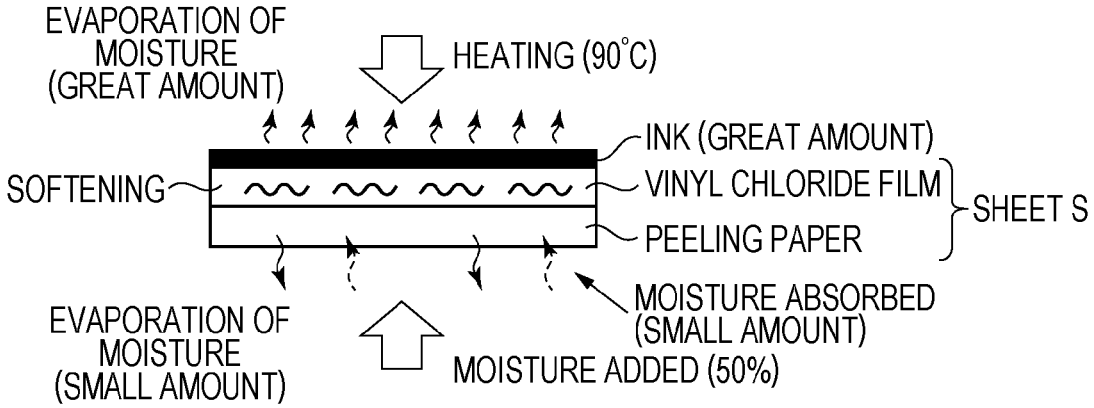

A feature of the present embodiment is to performing heating and moisturizing at the same time, to reduce shrinkage of the sheet S and variance in shrinkage thereof. This mechanism will be described with reference to FIGS. 6A and 6B. As described above, heating the sheet S causes the moisture included in the ink to evaporate, the vinyl chloride film to soften due to heat, and the moisture in the peeling paper to evaporate. Here, the sheet S is moisturized from the rear face (peeling paper side) at the same time as heating. Thus, the peeling paper absorbs the moisture from the moisturizing before loosing its moisture and shrinking, and accordingly shrinkage can be suppressed. The humidity is maintained at a predetermined humidity (50%), so there is an upper limit to the amount of moisture which the peeling paper will absorb. In other words, upon absorbing a certain amount of moisture, the peeling paper will not absorb any more, regardless of the amount of moisture evaporating therefrom, so the shrinkage of the sheet S can be maintained constant regardless of the amount of ink discharged onto the sheet S.

This mechanism enables shrinkage of the sheet S to be reduced. This way of suppressing shrinkage of the peeling paper by moisturizing is also meaningful from the perspective of preventing deterioration of the peeling paper, since repeated shrinkage of the peeling paper will damage the peeling paper and lead to deterioration of the paper itself.

Figure 7:
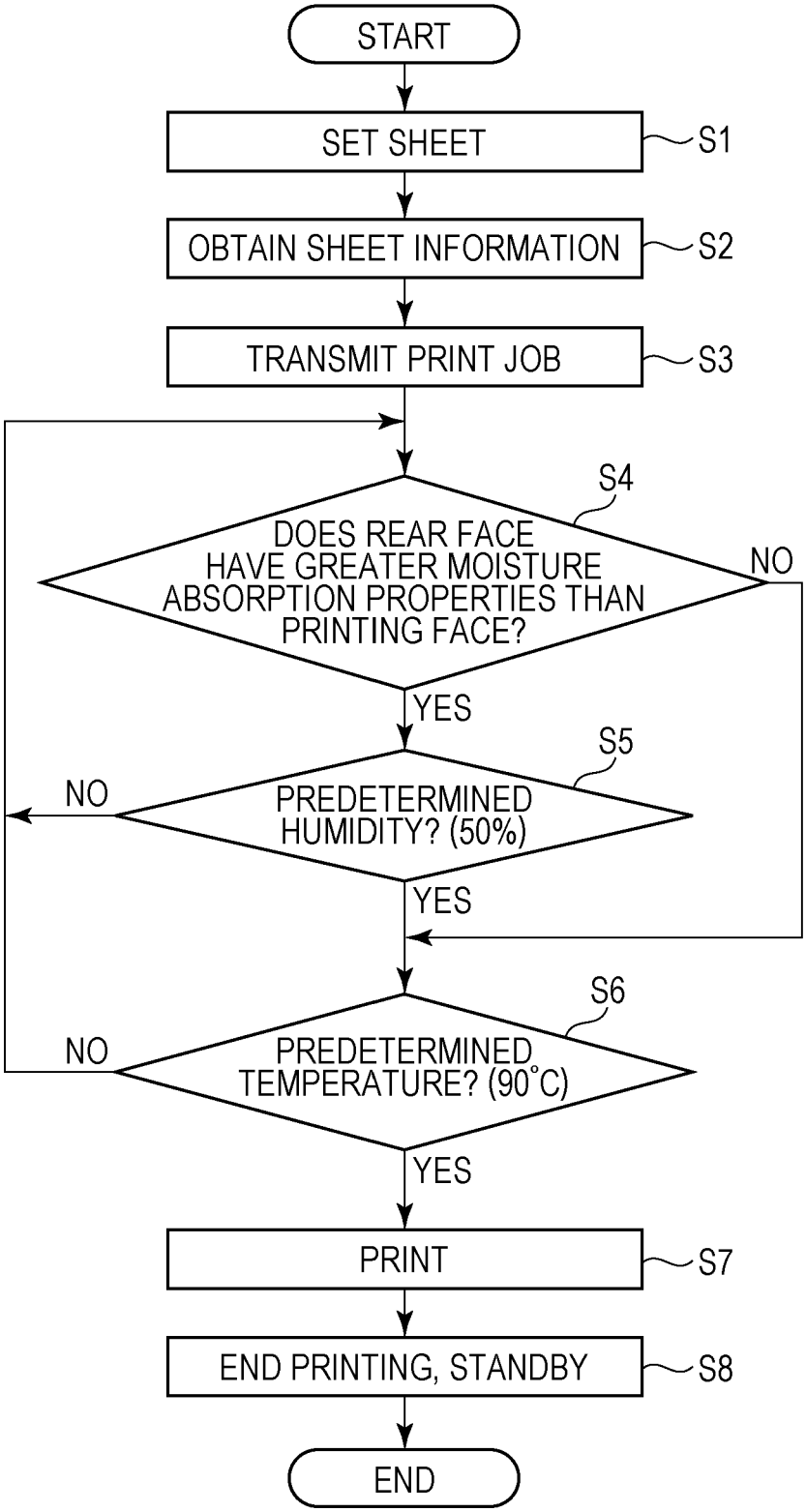
FIG. 7 is a flowchart illustrating operation procedures.

Next, image printing operation procedures will be described with reference to the flowchart in FIG. 7. As preparation for printing, a sheet S is set in the apparatus (step S1). The user attaches a roll-shaped sheet S to the sheet supply unit 2, unrolls the outer side of the roll, and winds the sheet onto the wind-up unit 12 by guiding the leading end of the sheet past the turn roller 21, conveyance roller pair, and turn roller 9.

The user inputs sheet information of the set sheet S from the input unit, so that the apparatus obtains this sheet information (step S2). Once the setting is completed, a print job is transmitted (step S3).

Determination is made regarding whether or not the sheet S, identified from the information obtained in step S2, has a rear face of which the water-absorbing property is greater than that of the printing face (step S4). In a case where the water-absorbing property of the rear face is greater than that of the printing face, the moisturizing unit 250 is used to moisturize until the humidity sensor 16 senses a predetermined humidity (step S5). The predetermined humidity is 50% in the case of a vinyl chloride sheet, but the set humidity is changed according to the type of sheet obtained in step S2. At the same time as step S5, the temperature sensor 90 heats the sheet S using the heating unit 8 until a predetermined temperature (approximately 90° C. here) is reached.

On the other hand, in a case where the water-absorbing property of the rear face is smaller than that of the printing face, there is no need to moisturize, so the moisturizing unit 250 is not driven and heating by the heating unit 8 alone is performed (step S6). Examples of this are cases where the rear face is not paper but polyethylene terephthalate (PET) or cloth. Thus, consumption of electric power and water to generate steam can be reduced.

Printing is performed once the predetermined temperature and humidity have been achieved (Step S7). The carriage 5 carrying the print head 10 reciprocally moves in the main scanning direction, the print head 10 discharges ink, and an image is printed on the sheet S one band at a time. Each time a band is printed, the sheet S is intermittently fed downstream in the sub-scanning direction.

The sheet S on which the image has been printed is fed to the heating unit 8 and moisturizing unit 250 downstream. the ink is solidified and fixed to the printing face of the sheet S by heating, while shrinkage of the rear face of the sheet S is suppressed by moisturizing. The heating unit 8 and moisturizing unit 250 are controlled so that the predetermined temperature and humidity are maintained while printing. Once the printing ends, the apparatus goes to a standby state for the next print job (step S8).

Note that obtaining sheet information is not restricted to a form where the user inputs from an input unit. For example, an optical sensor may be built into the platen 11 so that the material of the rear face is determined as the sheet S passes over the platen, thereby obtaining sheet information. Moreover, conveyance of the sheet S is not restricted to intermittent operation and may be continuous operation.

Figure 8A:
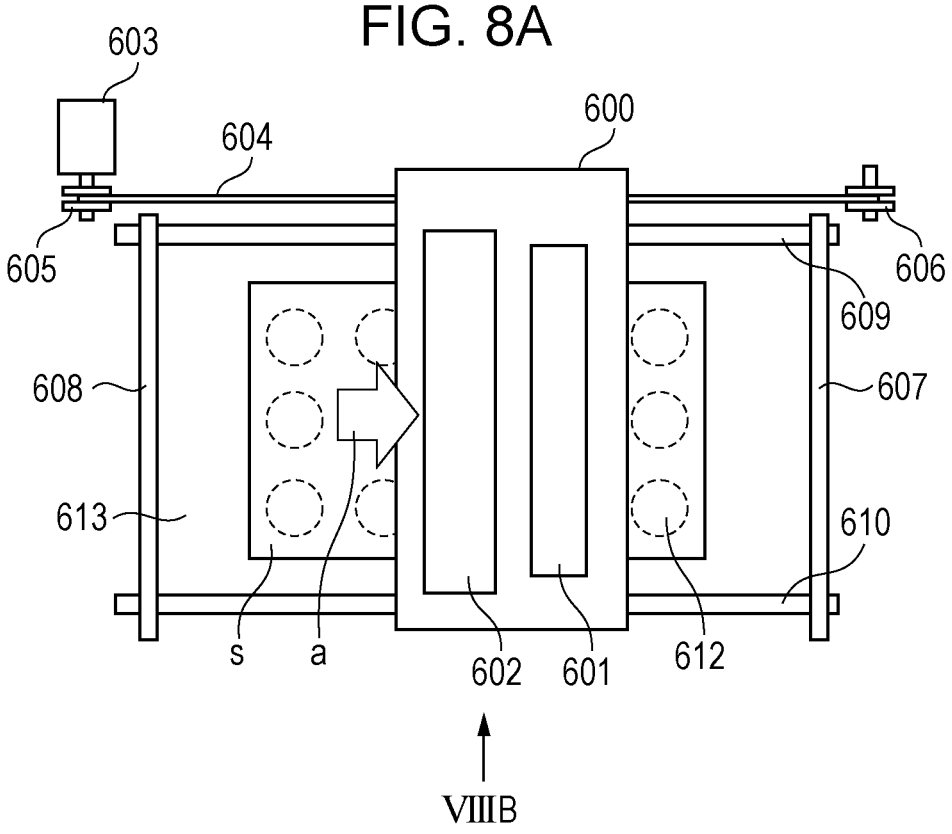
FIGS. 8A and 8B are diagrams illustrating a modification of the arrangement illustrated in FIG. 1.
Figure 8B:
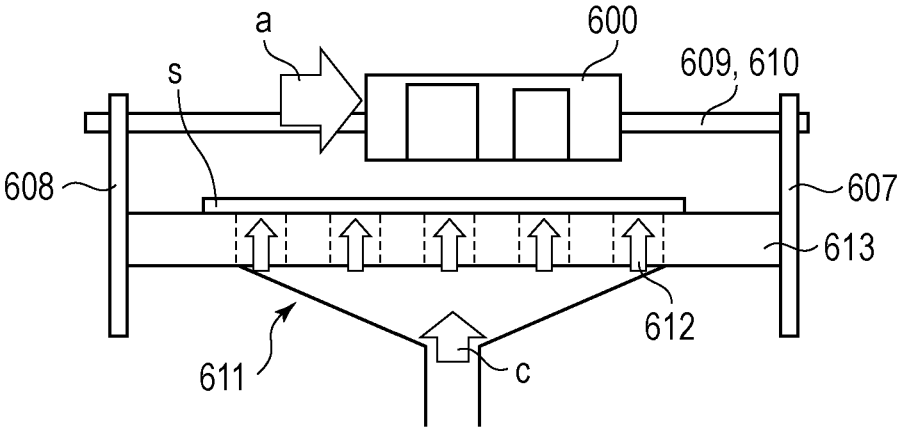

Moreover, a configuration may be made where the sheet S is fixed to a fixing table 613 as illustrated in FIGS. 8A and 8B. FIG. 8A is a diagram of the apparatus from above, and FIG. 8B is a view of the apparatus from the direction of arrow VIIIB in FIG. 8A. A print head 601 and heating unit 602 are held by a carriage 600. A fixing table 613 is situated on a plane facing the carriage 600. The carriage 600 is reciprocally movable in the direction indicated by the arrow a, by a carriage motor 603 using a belt 604 and pulleys 605 and 606. Both ends of the carriage 600 are supported by shafts 609 and 610, the shafts 609 and 610 being fixed to side plates 607 and 608. A moisturizing unit 611 is provided at the opposite side of the fixing table 613 from the printing face. The fixing table 613 is also provided with multiple evacuation ports 612 to blow steam on the rear face of the sheet S. The steam is supplied from an unshown steam generating unit, and fed in the direction indicated by the arrow c. Printing is performed by printing using the print head 601 and fixing the ink using the heating unit 602 while moving the carriage 600 in the direction of the arrow a. The moisturizing unit 611 performs moisturizing during this time, whereby shrinkage of the sheet S can be suppressed. Note that an arrangement may be made where the moisturizing unit 611 can reciprocally moved in the direction of the arrow a, in conjunction with the carriage 600.

According to the present embodiment, a first face of a sheet on which an image has been printed is heated, and a second face which is the rear face side is moisturizing, whereby shrinkage of the sheet is suppressed. Accordingly, seams among printed articles, when creating a large display of multiple printed articles arrayed with no space therebetween, become inconspicuous, leading to improved image quality. The effects of suppressing shrinkage of the sheet by placing the moisturizing unit and heating unit so as to face each other across the sheet S and performing heating and moisturizing at the same time are great. Further, shrinkage suppression suitable for sheet properties can be realized by changing the amount of moisturizing depending on the type of sheet being used.

Figure 9:
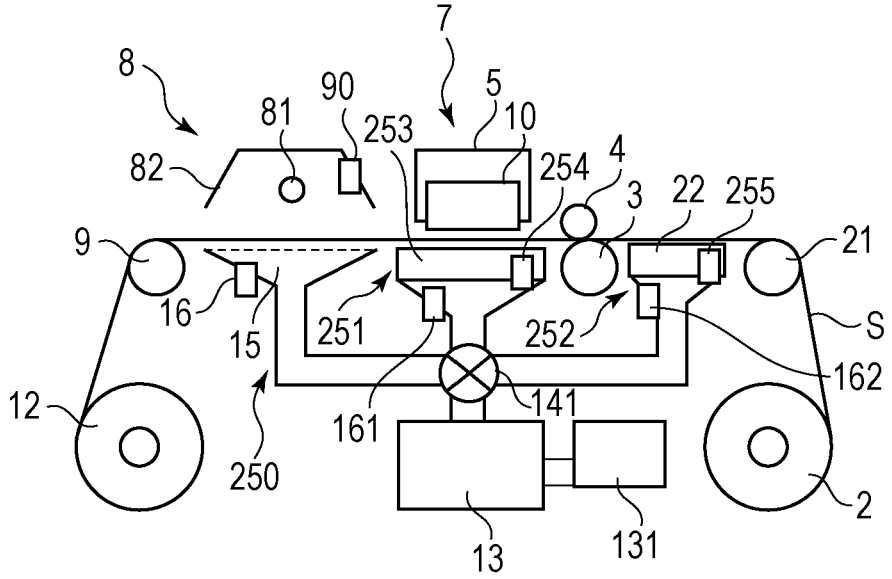
FIG. 9 is a cross-sectional diagram illustrating the configuration of a printing apparatus according to a second embodiment.

FIG. 9 is a cross-sectional view of the overall configuration of a printing apparatus according to a second embodiment. The second embodiment differs from the first embodiment in that it has multiple heating units and moisturizing units.

The heating unit is configured including the three units of the main heating unit 8, a heater-containing platen 253, and a pre-heater 22. The heating unit 8 is of the same configuration as that in the first embodiment. The heater-containing platen 253 is the platen 11 according to the first embodiment, to which a heating mechanism, capable of heating a sheet passing surface to a predetermined temperature, has been added. The advantages of having a heater in the platen is as follows. A vinyl chloride sheet is a medium which does not readily absorb ink, so in a case where ink droplets ejected from the pint head 10 land on each other, they pull and move each other by surface tension leading to blurring in the image. Accordingly, heating the ink droplets immediately after landing to evaporate the moisture is preferable from a perspective of preventing moving of the droplets, so a heater function has been added to the platen to this end.

The pre-heater 22 is disposed between the turn roller 21 and the conveyance roller pair. The sheet S is heated upstream in the sub-scanning direction before printing, to stabilize the temperature. Thus, image deterioration such a blurring and the like can be further reduced. These heating units are provided with temperature sensors 16, 254, and 255. The temperature on the sheet S is controlled to a predetermined temperature based on the information from the temperature sensors.

The heating unit 8 is controlled to 90° C., the same as with the first embodiment. The heater-containing platen 253 is controlled to approximately 60° C. which is a temperature suitable for suppressing blurring. The pre-heater 22 also is controlled to approximately 60° C., in the same way as with the heater-containing platen 253. While the heater-containing platen 253 and pre-heater 22 in the present embodiment are types of heaters which heat the sheet S from the rear face, this is not restrictive, and a heat radiance discharge type heater may be used in the same way as with the heating unit 8, or a different type may be used.

The moisturizing unit has three moisturizing units 250, 251, and 252, in accordance with the three heating units described above. The moisturizing unit 250 is of a configuration facing the heating unit 8 across the sheet S, in the same way as with the first embodiment. The evacuation ports of the moisturizing units 251 and 252 are provided where the heater-containing platen 253 and pre-heater 22 come into contact with the sheet S (sheet passing surface) so as to moisturize the rear face of the sheet S. The moisturizing units 250, 251, and 252 are connected to a single steam generating unit 13 via steam ducts. A switching valve 141 is provided to the merging point of the multiple moisturizing units. Humidity sensors 16, 161, and 162 are provided near the outlet of the respective moisturizing units.

The switching valve 141 is switched as steam is supplied from the steam generating unit 13, so that the humidity near the rear face of the sheet S is a predetermined humidity suitable for that sheet (50% in the case of vinyl chloride), based on the information from the humidity sensors. All three moisturizing units 250, 251, and 252 may be used for moisturizing, or a certain one or two may be used. Note however, that the heating unit 8 is the hottest at approximately 90° C., and accordingly moisture of the peeling paper evaporates most readily, so moisturizing at the rear face of the heating unit 8 is most effective.

The printing operations of image printing will be described. Upon printing being started, the sheet S has the conveyance path thereof changed from the sheet supply unit 2 to the sub-scanning direction by the turn roller 21. Subsequently, the sheet S is preheated to approximately 60° C. by the pre-heater 22. The preheated sheet S is nipped by the conveyance roller pair which is the conveyance roller 3 and pinch roller 4, and conveyed to the printing unit 7. The sheet S is heated to approximately 60° C. by the heater-containing platen 253 at the printing unit 7. The print head 10 discharges ink into the sheet S which is being heated, thereby preforming printing. The sheet S is subsequently conveyed to the heating unit 8 and heated to 90° C., whereby the emulsion ink forms a film and is fixed. Also, in the same way as with the first embodiment, sheet information may be obtained and driving of the steam generating unit 13 stopped in a case where the rear is not paper.

According to the present embodiment, a configuration including a heating mechanism which also heats during printing or before printing can also prevent shrinkage of sheets while preventing image deterioration, by appropriate situating of moisturizing units.

Figure 10:
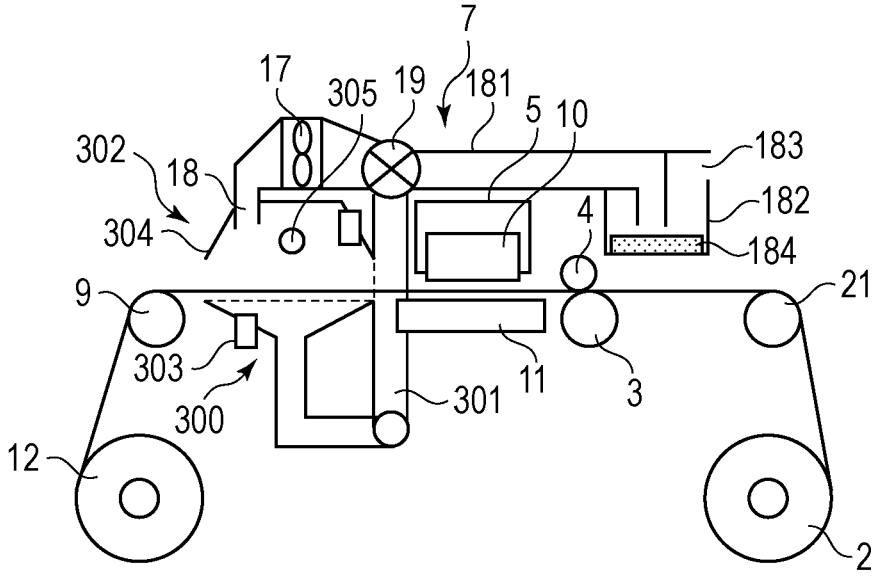
FIG. 10 is a cross-sectional diagram illustrating the configuration of a printing apparatus according to a third embodiment.

FIG. 10 is a cross-sectional view of the overall configuration of a printing apparatus according to a third embodiment. The third embodiment differs from the first embodiment in that the heating unit is configured as follows.

The first embodiment has a steam generating unit 13 serving as a steam generating source for moisturizing. With this arrangement, water must be supplied to the water tank 131 before it runs dry. Conversely, with the present embodiment, steam (moisturized air) generated by heating the water included in the ink droplets, printed by ink-jet printing of aqueous ink, is reused.

A moisturizing unit 300 includes a steam recovery opening 18 (recovery unit), a fan 17 to generate an air flow for suctioning and feeding steam, and a switching valve 19 for switching steam feeding destinations. Also, a steam duct 301 switchably connected by the switching valve 19 moisturizes the sheet S at an evacuation port to supply steam to the rear side of the sheet S. A humidity sensor 303 is provided within the evacuation port, so as to detect humidity in the same way as with the first embodiment. Further, an evacuation duct 181, a steam removal unit 182, and external evacuation port 183, are provided as other branching flow passages of the switching valve 19. An absorbent material 184 is disposed in the steam removal unit 182.

The operations of image printing are the same as with the first embodiment up to ink being discharged onto the sheet S by the printing unit 7 so as to perform printing. The sheet S after printing is conveyed to the heating unit 302, and heated by a fixing heater 305. Thus, the moisture included in the ink droplets is evaporated, and steam fills a space surrounded by a reflector 304. Driving the fan 17 suctions the steam from the steam recovery opening 18. Subsequently, the steam passes through the switching valve 19 and steam duct 301 and is fed to the evacuation port. The rear face of the sheet S is moisturized using this heat from the evacuation port. Upon the humidity sensor 303 detecting a predetermined humidity obtained from the sheet information (50% in the case of vinyl chloride), the switching valve 19 switches connection to the evacuation duct 181. The steam is fed from the evacuation duct 181 to the steam removal unit 182, and is blown against the absorbent material 184, whereby the steam blow thereupon returns to water and is absorbed by the absorbent material 184. Accordingly, air with lowered humidity is discharged from the external evacuation port 183, and there is no condensation of humidity outside of the apparatus (e.g., on the walls of the room where the apparatus is installed, and so forth).

Figure 11:
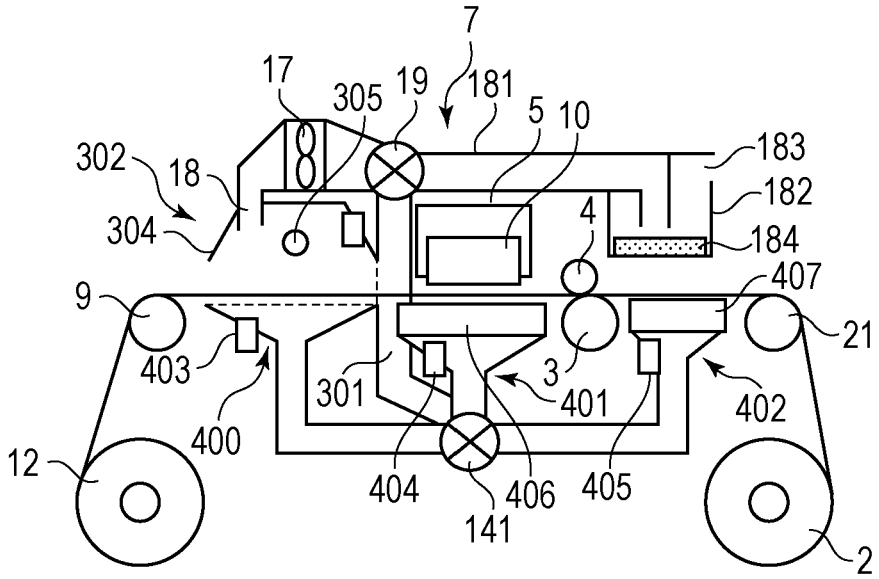
FIG. 11 is a diagram illustrating a first modification of the arrangement illustrated in FIG. 10.

FIG. 11 is a modification of FIG. 10. A configuration having the multiple heating units and moisturizing units, in the same way as with the second embodiment (FIG. 9), is added to the configuration which generates steam using moisture of the ink droplets. The heating unit is configured including the three units of the heating unit 302, a heater-containing platen 406, and a pre-heater 407, in the same way as with the second embodiment. The configuration of the moisturizing unit is the same as that of the third embodiment, up to where the steam is collected by the steam recovery opening 18, and fed to the moisturizing unit by the switching valve 19 and steam duct 301. The present example differs from this configuration with regard to the point that the steam is thereafter supplied to the moisturizing units 400, 401, and 402 via the switching valve 141. The configurations of the moisturizing units 400, 401, and 402 are the same as with the second embodiment. Accordingly, shrinkage of the sheet S can be reduced while preventing deterioration in image quality due to blurring and the like.

While the steam recovery opening 18 is disposed on the reflector 304 of the heating unit 302, this may be provided near to the printing unit 7 if the amount of generated steam is great, of may be provided to both the heating unit 302 and the printing unit 7. Further, an arrangement may be made where sheet information is obtained, and driving if the steam generating unit 13 is stopped if the rear is not paper, in the same way as with the first embodiment. Also, an arrangement may be made where the switching valve 19 is switched to the evacuation duct 181 side, or the fan 17 is stopped, if the rear is not paper.

Figure 12:
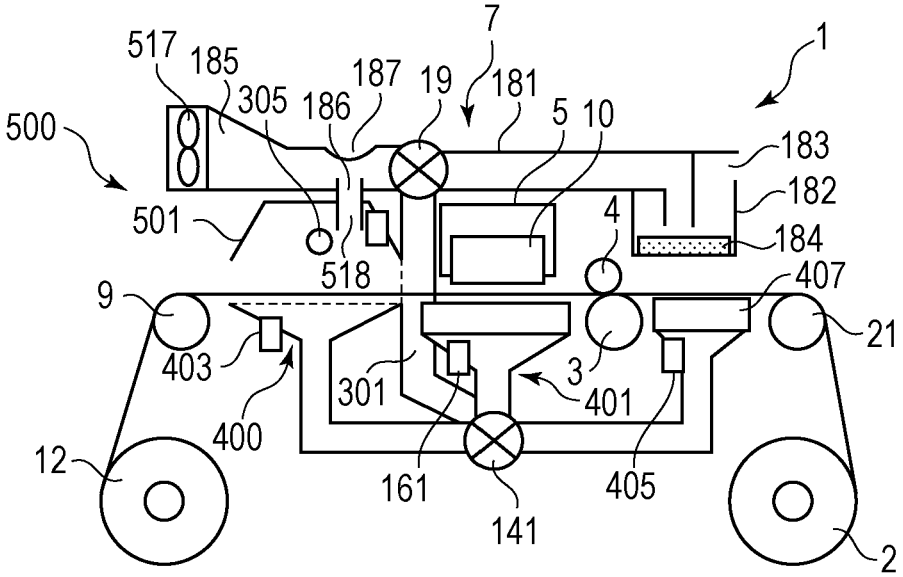
FIG. 12 is a diagram illustrating a second modification of the arrangement illustrated in FIG. 10.

FIG. 12 illustrates the configuration of a further modification. Part of the configuration of steam suctioning in FIG. 11 has been modified. External air is taken into a duct 185 from an inlet configured including a fan 517. An opening portion 186 connected to a recovery opening 518 provided to a reflector 501 is provided in the duct 185. Steam flowing in from the recovery opening 518 joins flow with the external air being taken in from the fan 517, at the opening portion 186. A recessed portion 187 is provided near the opening portion 186, which is the portion of merging with the duct 185, and the cross-sectional area of the channel gradually narrows as compared to other portions of the duct 185. The cross-sectional area of the channel the returns to the original size downstream in the direction of feeding air, and thus connected to the switching valve 19. Other configurations are the same as with FIG. 11 described above.

In the configuration in FIG. 12, when the external air is suctioned by the fan 17 and fed to the duct 185, the channel area decreases at the recessed portion 187, and accordingly the flow velocity increases. This increases negative pressure at the recessed portion 187, so the steam being generated within the reflector 501 is suctioned by the recovery opening 518. Subsequent operations and effects are the same as those in FIG. 11. This configuration avoids steam from coming into contact with the fan 517, since the generated steam does not directly pass through the fan 517. This reduces droplets of water generated when the steam passes through the fan 17, thereby reducing damage to the fan 17. Note that part of the configuration of steam suctioning in FIG. 10 may be modified to have a steam suctioning configuration such as illustrated in FIG. 12.

According to the present embodiment, in addition to the advantages of the above-described first embodiment, sheet shrinkage can be reduced without providing an independent steam generating unit. Also, steam that is generated is speedily suctioned and around the heading portion is maintained at low humidity, thereby promoting fixing of the ink. Moreover, the generated steam does not directly pass through the fan 17, thereby reducing damage thereto.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2013-125711 filed Jun. 14, 2013, which is hereby incorporated by reference herein in its entirety.

What is claimed is:

1. A printing method, comprising:

preparing a sheet having a first face and a second face, wherein the first face has resin and the second face has a water-absorbing property greater than the first face;

conveying the sheet;

printing an image with ink including emulsion on the first face of the sheet being conveyed;

heating the printed first face at a heating area and moisturizing the second face at a moisturizing area, wherein the heating area and the moisturizing area are disposed opposing one another whereby a same part of the sheet being conveyed is sandwiched between the heating area and the moisturizing area, and the heating and the moisturizing are performed simultaneously on the same part of the sheet.

2. The printing method according to claim 1, wherein moisturizing the second face occurs before or during printing.

3. The printing method according to claim 1, wherein steam generated by the heating is collected and reused to generate moist air for the moisturizing.

4. The printing method according to claim 1, wherein an amount of moisturizing is changed according to the type of sheet used.

5. The printing method according to claim 1, wherein the sheet is continuous and, the second face has peeling paper.

6. A printing apparatus comprising:

a conveying unit configured to convey a sheet having a first face and a second face wherein the second face has a water-absorbing property greater than the first face;

a printing unit configured to print an image with ink on the first face;

a heating unit configured to heat the first face; and a moisturizing unit configured to moisturize the second face wherein a heating area of the heating unit and a moisturizing area of the moisturizing unit are disposed downstream of a printing area of the printing unit in the direction of conveyance of the sheet, and the heating area and the moisturizing area are disposed opposing one another whereby a same part of the sheet being conveyed is sandwiched between the heating area and the moisturizing area, and the heating and the moisturizing are performed simultaneously on the same part of the sheet.

7. The printing apparatus according to claim 6, wherein a heater that heats the sheet before or at the time of printing is disposed upstream from the heating unit.

8. The printing apparatus according to claim 7, further comprising:

a recovery unit configured to recover steam generated by the heating of the sheet at the heating unit and provide the recovered steam to the moisturizing unit for reuse.

9. The printing apparatus according to claim 8, wherein the recovery unit includes a duct configured to recover the steam from a recovery opening near the heating unit and guide the steam to the moisturizing unit, and a fan configured to generate air flow at the duct.

10. The printing apparatus according to claim 9, wherein the recovery unit is configured to take in air by the fan from an intake opening different from the recovery opening, and generate an air flow at the duct, and wherein a cross-sectional area of the channel of the recovery unit gradually becomes smaller from the intake opening to a flow merging position with the recovery opening.

11. The printing apparatus according to claim 6, wherein the sheet is continuous.

* * * * *